United States Patent [19]

Tsai

[11] Patent Number: 5,036,740

[45] Date of Patent: Aug. 6, 1991

[54] ROLLER-PRESSED FILM CUTTER APPARATUS

[76] Inventor: Chang-Ta Tsai, P. O. Box 55-1670, Taipei, Taiwan

[21] Appl. No.: 516,794

[22] Filed: Apr. 30, 1990

[51] Int. Cl.[5] ..... B26D 5/10

[52] U.S. Cl. ..... 83/455; 83/614

[58] Field of Search ..... 83/578, 614, 649, 454, 83/455, 505; 225/43

[56] References Cited

U.S. PATENT DOCUMENTS

| | | | |
|---|---|---|---|
| 3,137,192 | 6/1964 | McNeill | 83/455 |
| 3,199,394 | 8/1965 | Castelli | 83/614 X |
| 3,277,760 | 10/1966 | Keene et al. | 83/455 |
| 3,688,625 | 9/1972 | Thomas et al. | 83/614 |
| 4,197,774 | 4/1980 | Singh et al. | 83/614 X |
| 4,210,043 | 7/1980 | Urion et al. | 83/455 X |
| 4,257,294 | 3/1981 | Stoveken | 83/455 |
| 4,787,284 | 11/1988 | Chen | 83/614 |
| 4,960,022 | 10/1990 | Chuang | 83/649 X |

*Primary Examiner*—Z. R. Bilinsky

[57] ABSTRACT

A film cutter includes a slide holder having four rollers rotatably mounted in the holder and rotatably moving on a track, a central cutting blade formed in a central portion under the holder, and a slide base secured with the cutting blade and positioned under the slide holder slidably engageable in a longitudinal groove formed in the track, whereby upon a pulling of a film across the track and upon a pushing of the slide holder, the rollers will press to tension the film against the track for stably, smoothly and quickly cutting the film as cut by the cutting blade secured between the upper slide holder and the lower slide base.

1 Claim, 3 Drawing Sheets

ROLLER-PRESSED FILM CUTTER APPARATUS

BACKGROUND OF THE INVENTION

Singh et. al disclosed a traveling cutter assembly in their U.S. Pat. No. 4,197,774 for severing a sheet into desired length, which however may have the following drawbacks:

1. Even the sheet to be severed is locally immobilized against the edges 36 of the groove ridges 34 for minimizing the tendency of the sheet to be buckled or plowed when cut by the cutting blades 56, the serrations 32, 34 may slow down the sliding movement of the cutter slide 20 on the track 10.

2. For making the V-shaped grooves 32 and the upper ridges 34 of the track 10, the production cost thereof will be increased.

3. If using the cutter having such V-shaped grooves 32 and upper ridges 34 for cutting a very thin film such as a wrap film, the film when pressed between the slide 20 and the upper surface 30 of the track 10 may still be wrinkled or plowed to influence a packing appearance of a sophisticated or precious present or article wrapped with the wrinkled film.

The present inventor has found the drawbacks of such a conventional cutter and invented the present roller-pressed film cutter apparatus.

SUMMARY OF THE INVENTION

The object of the present invention is to provide a film cutter apparatus including a cutter means slidably moving on a track means having a plurality of rollers rotatably mounted in the cutter means and rotatably pressing on a film against the track means to stabilize and facilitate the film cutting operation by the cutter means.

DETAILED DESCRIPTION

Figure 5:
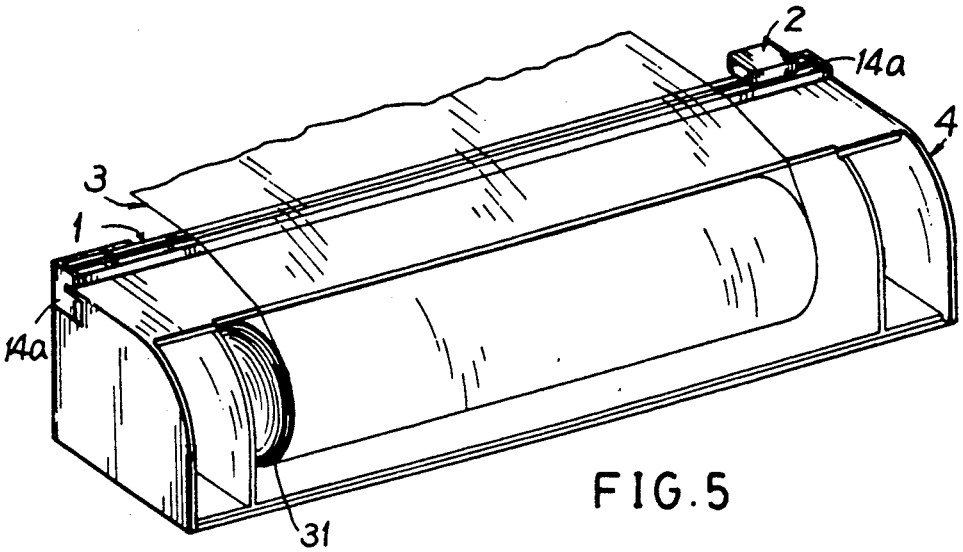
FIG. 5 is an illustration showing an assembly of the present invention on a casing stored with a wrap film roll.
Figure 4:
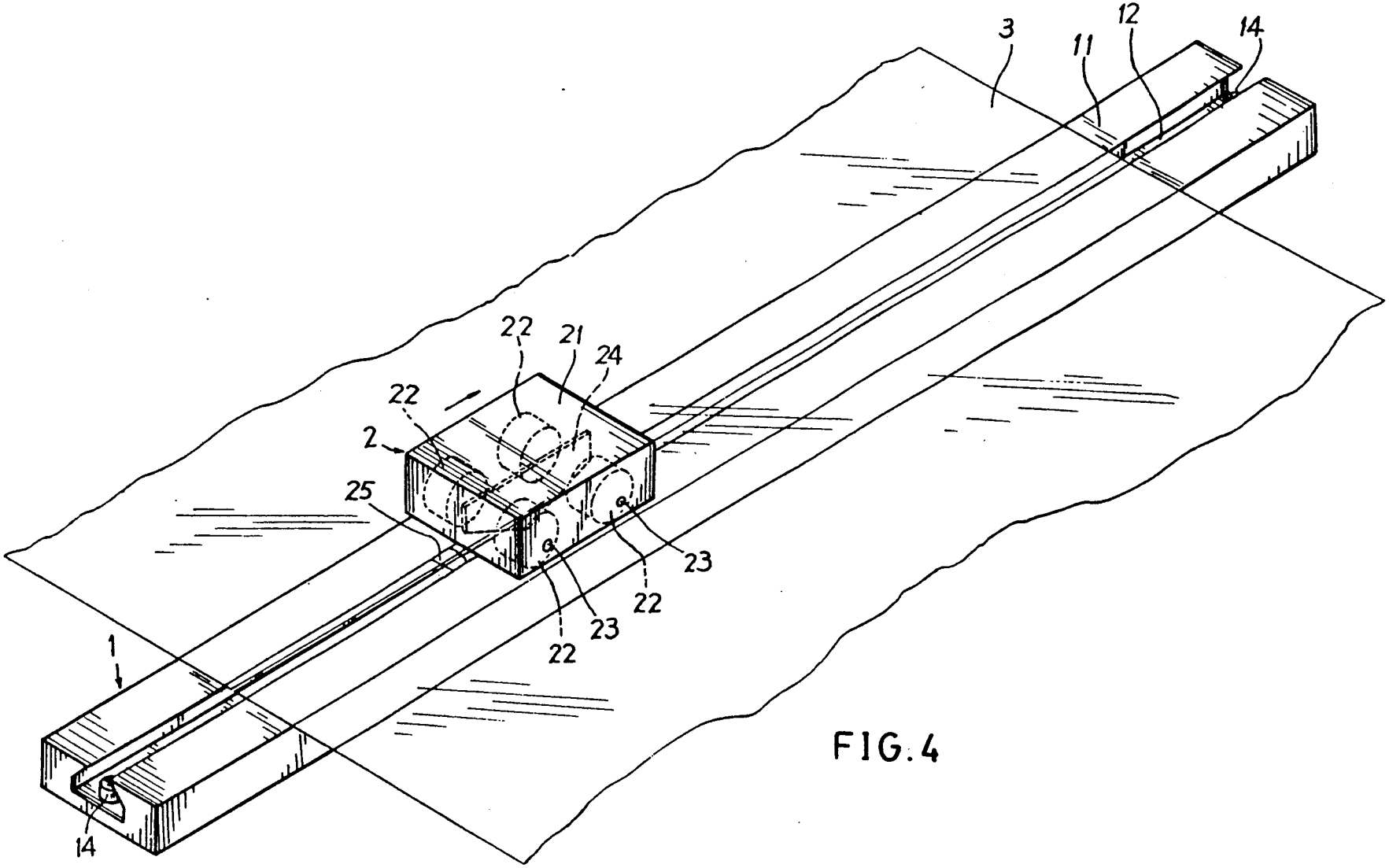
FIG. 4 is an illustration showing a cutting operation of the present invention.

As shown in FIG. 1–4, the present invention comprises: a track means 1 and a cutter means 2 slidably mounted on the track means 1. The track means 1 may be fixed on an upper surface of a casing 4 stored with a wrap film roll 31 in the casing 4 so that a wrap film 3 can be directly pulled outwardly from the casing 4 to be cut by the cutter means 2 slidably held on the track means 1 as shown in FIG. 5. However, the casing 4 as shown herewith is not claimed and limited in this invention. The wrap film 3 to be cut in this invention may be selected from a very thin film such as PVC, PE or other plastic films either transparent or opaque. The present invention may also be used for cutting sheet, cloth, paper or other film-like materials.

The track means 1 includes a longitudinal flat surface 11 formed on the upper surface of the track means 1, a dovetail-shaped longitudinal groove 12 longitudinally recessed in the longitudinal flat surface 11, and two stoppers 14 fixed in two end holes 13 respectively formed on two opposite end portions of the track means 1. The stopper 14 may be substituted with an ending plate **14*a* as shown in FIG. 5 for limiting the reciprocative sliding movement of the cutter means 2**.

The cutter means 2 includes: a slide holder 21 having a plurality of sockets 211 recessed in its bottom portion, a plurality of rollers 22 rotatably mounted in the sockets 211 each roller 22 pivotally secured to the holder 21 around a pin 23 fixed into a pin hole 210 laterally formed through the holder 21, and a central cutting blade 24 fixed in a slide base 25 secured to and positioned under the holder 21.

The cutting blade 24 of the cutter means 2 has its lower portion fixed into the slide base 25 and has its upper portion inserted into a slot 212 longitudinally formed in a central portion in the holder 21. The blade 24 is formed with two pin holes 241 to be fixed with the pins 23 passing through the holes 210 formed in the holder 21 and formed with two sloping cutting edges 240 on both front and rear ends of the blade 24 for cutting the film 3. The rollers 22 are symmetrically disposed on two opposite sides of the central cutting blade 24.

The slide base 25 of the cutter means 2 is slidably engageable with the dovetail shaped longitudinal groove 12 of the track means 1 and has a cross section generally shaped as a triangular or dovetail shape, snugly engageable with the groove 12. For facilitating the sliding movement of the cutter means 2 in the track means 1, a lubricating oil or grease may be filled in the groove 12 for lubricating purpose.

When using the present invention for cutting a wrap film 3, the film 3 is pulled across the flat surface 11 of the track means 1 and the holder 21 of the cutter means 2 is pushed and depressed by the user to rotate the rollers 22 for moving the cutter means 2 on the track means 1 and to press the rollers 22 against the film 3 and the flat surface 11 of the track means 1, thereby tensioning the film 3 in situ and cutting the film smoothly and quickly.

The present invention has the following advantages superior to a conventional cutter assembly:

1. The cutter means 2 as provided with the rollers 22 may tension the film 3 to be cut in situ during the cutting operation and may facilitate the rolling sliding movement of the cutter means 2 on the track means 1 for a quicker cutting operation.

2. Since the track surface 11 is so flat and the rollers 22 of the cutter means 2 are rolling on the film 3 and the track means 1, the film even made so thin will not be wrinkled or plowed during the cutting processing.

3. The elements in construction of the present invention are not complex in their structure so that the production cost can be greatly reduced and their maintenance problems can also be minimized.

The number of the rollers 22 of the cutter means 2 are not limited in this invention, but are preferably four rollers 22 rotatably mounted in the holder 21 for a stable, smooth running on the track means 1.

Figure 1:
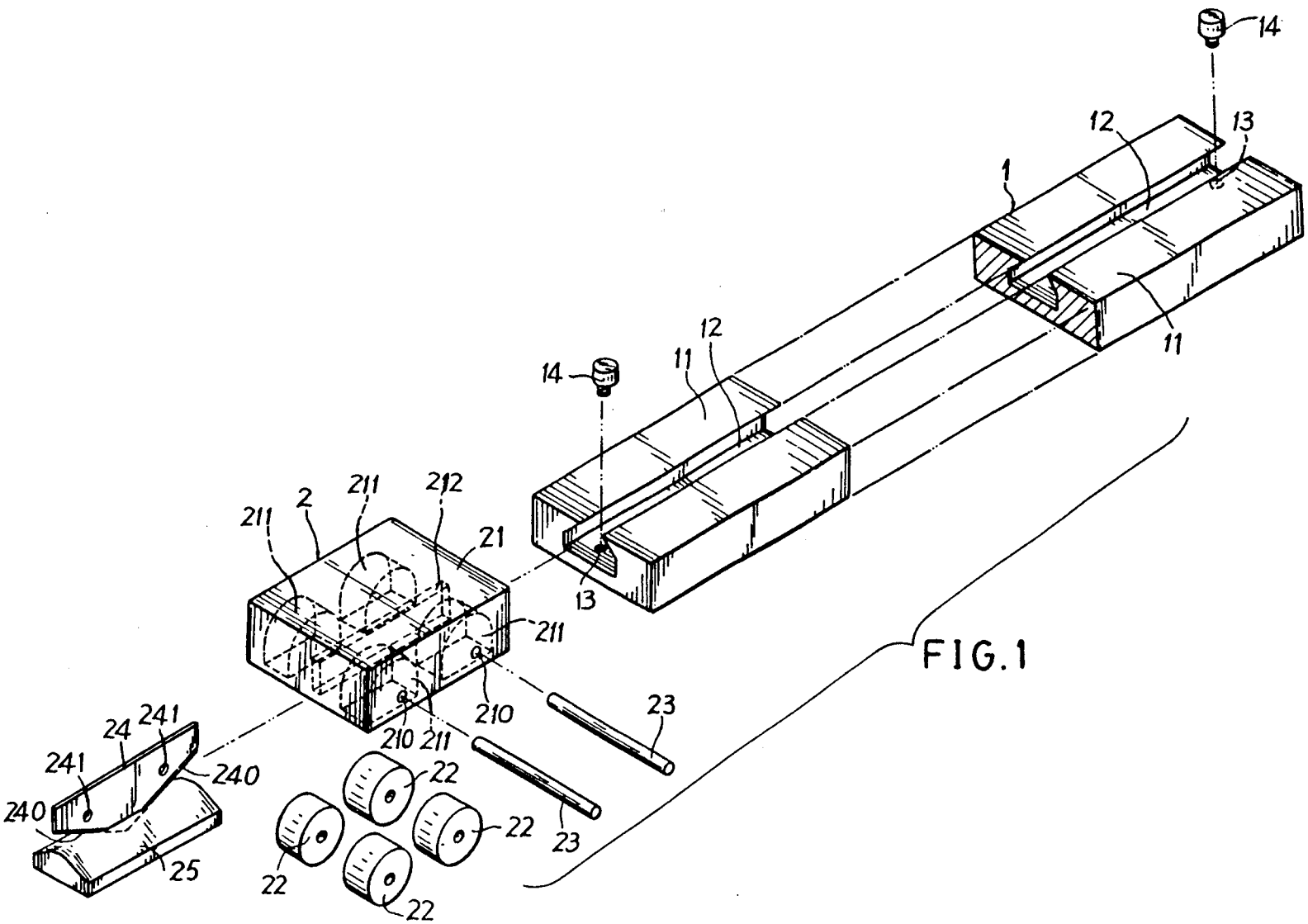
FIG. 1 is an exploded view showing all elements in construction of the present invention.
Figure 2:
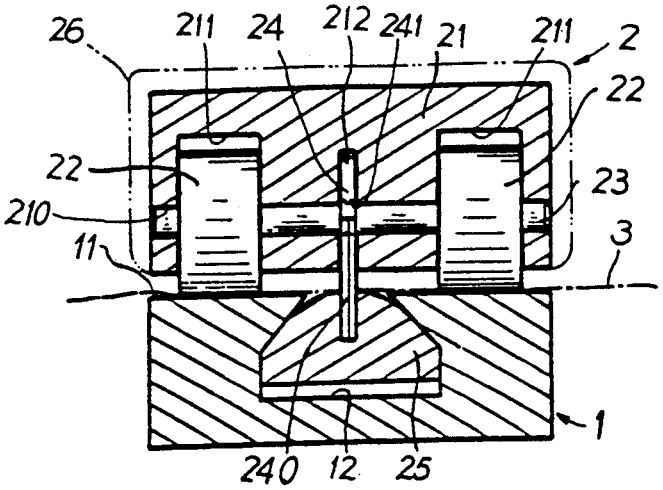
FIG. 2 is a cross sectional view of the cutter means of the present invention.
Figure 3:
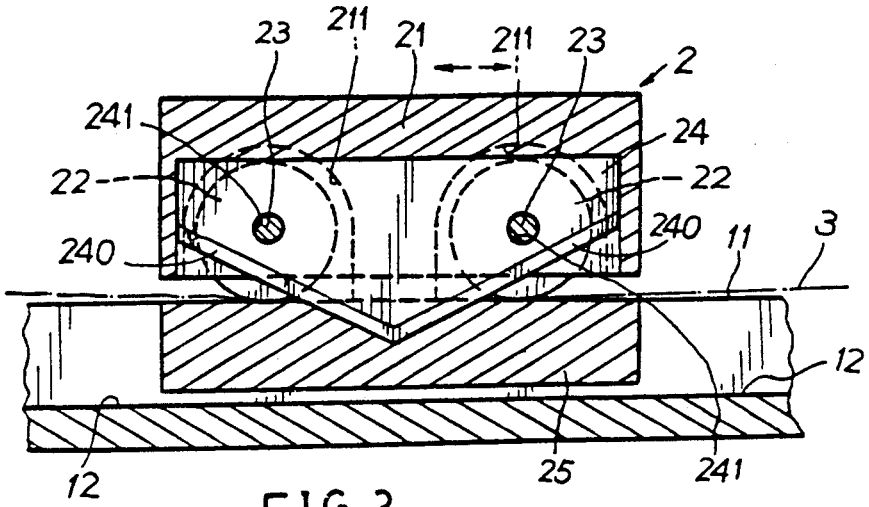
FIG. 3 is a longitudinal sectional drawing of the cutter means of the present invention.

The blade 24, the base 25 and the holder 21 may also be integrally formed by molding process wellknown in plastic molding processes. As shown in FIG. 2, a cover 26 may be provided to encompass the holder 21 and the pins 23 within the cover 26 for shielding or decorative purpose or for marking purpose.

I claim:

1. A film cutter apparatus comprising:

a track means having a longitudinal flat surface formed on an upper surface of the track means and a longitudinal groove longitudinally recessed in the upper flat surface of the track means; and a cutter means slidably mounted on said track means having a central cutting blade fixed in said cutter means for cutting a film when pulled across the upper flat surface on said track means, the improvement which comprises:

said cutter means including a slide holder having four rollers symmetrically disposed on two opposite sides of the central cutting blade rotatably mounted in said holder rotatably moving on said upper flat surface and pressing the film against the upper flat surface for a smooth film cutting operation, said cutting blade fixed on a slide base slidably engageable in said longitudinal groove in said track means and secured to a bottom slot formed in the slide holder;

said four rollers rotatably mounted in four sockets formed in a bottom of said slide holder by two pins each pin fixed through each first pin hole laterally formed in said slide holder; said cutting blade formed with two second pin holes in said blade to be fixed with said two pins rotatably mounting the rollers in said slide holder; and said longitudinal groove in said track means having a cross section of said groove formed as a dovetail shape engageable with the slide base of the cutter means, said slide base having a cross section thereof formed as a dovetail shape.

* * * * *